United States Patent [19]

Nyzell

[11] Patent Number: 4,605,372

[45] Date of Patent: Aug. 12, 1986

[54] TRAINING MEANS FOR A WEAPON

[75] Inventor: Jan-Erik Nyzell, Eskilstuna, Sweden

[73] Assignee: Affarsverket FFV, Eskilstuna, Sweden

[21] Appl. No.: 720,287

[22] Filed: Apr. 4, 1985

[30] Foreign Application Priority Data

Apr. 9, 1984 [SE] Sweden ..... 8401963

[51] Int. Cl.[4] ..... F41F 27/00; F41G 3/26

[52] U.S. Cl. ..... 434/16; 89/29

[58] Field of Search ..... 434/16, 19, 11, 12, 434/24; 89/29

[56] References Cited

U.S. PATENT DOCUMENTS 2,342,684 2/1944 Nelson ..... 89/29
2,674,923 4/1954 Brandt ..... 434/12
3,088,225 5/1963 Amistadi ..... 434/24
4,362,145 12/1982 Stelcher ..... 434/12 X

FOREIGN PATENT DOCUMENTS 738153 7/1966 Canada ..... 434/11

*Primary Examiner*—William H. Grieb
*Attorney, Agent, or Firm*—Fleit, Jacobson, Cohn & Price

[57] ABSTRACT

Training device for shooting with a weapon intended for use with live ammunition. The training device includes a sub-calibre barrel, which is attached inside a holder, which is capable of being locked in the barrel of the weapon. The sub-calibre barrel can be zeroed by means of four adjusting elements, of which two are spring-loaded and are in contact with the sub-calibre barrel whereas the other two are capable of radial displacement in relation to the sub-calibre barrel by individual operating rods running axially to the sub-calibre barrel.

3 Claims, 2 Drawing Figures

TRAINING MEANS FOR A WEAPON

Figure 1:
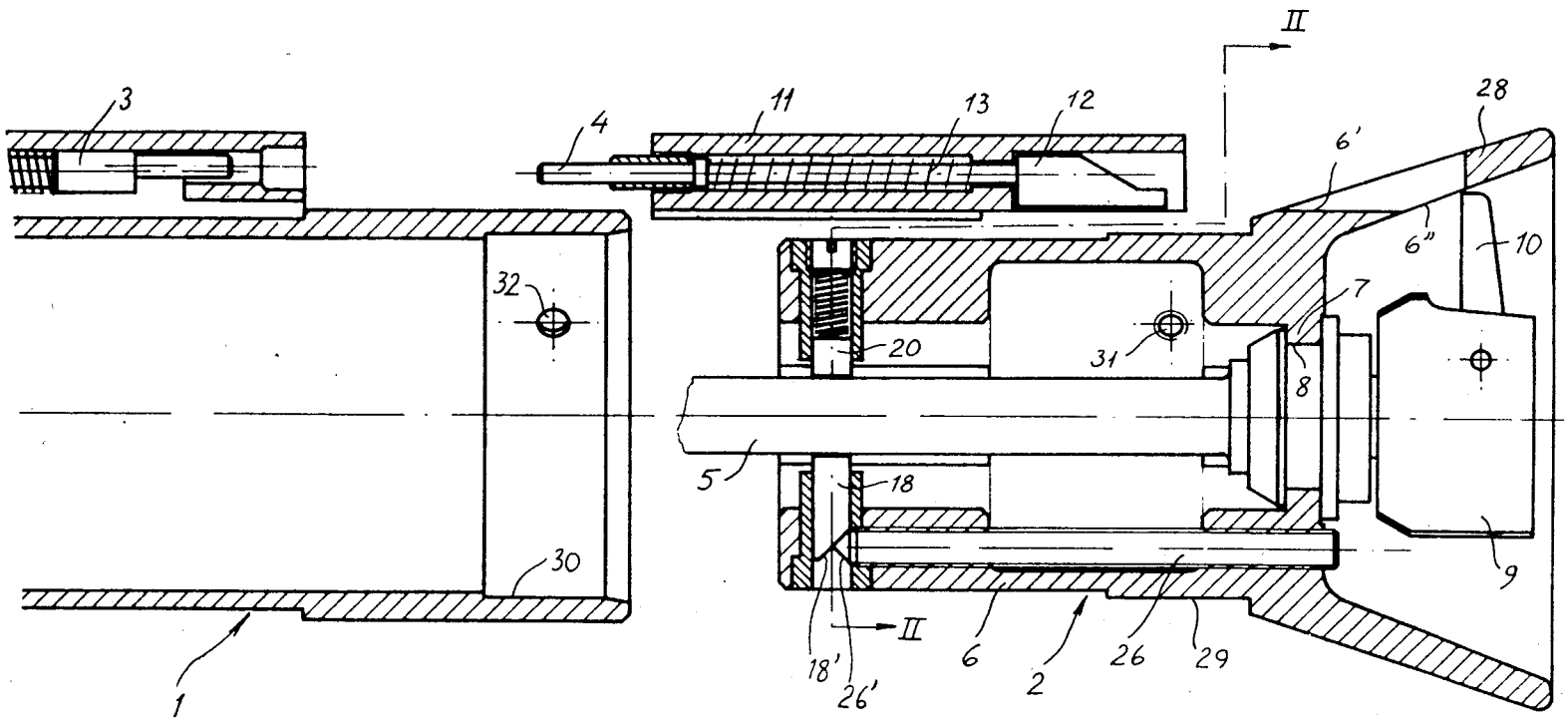

The present invention relates to a training means for shooting with a weapon intended for use with live ammunition, said means comprising a sub-calibre barrel, which is attached inside a holder, which is capable of being placed inside the barrel of said weapon, said holder exhibiting four adjusting elements in contact with the sub-calibre barrel and capable of displacement in its transverse direction in order to provide zeroing of the sub-calibre barrel. The invention is particularly, although not exclusively applicable to shooting training exercises with recoilless weapons.

In conjunction with shooting training exercises with a weapon, referred to below as the principal weapon, intended for use with live ammunition, it is usual to make use of insert barrels with a smaller calibre than that of the principal weapon together with a firing means for the ammunition for which the insert barrel is intended. The insert barrel with its firing means constitutes a training means known as a "training weapon", and the former is given approximately the same external shape and size as live ammunition. As a general rule, therefore, the training weapon consists of a sleeve inside which is installed a sub-calibre barrel for sub-calibre ammunition, a removable breech containing at least one holder for the sub-calibre ammunition, a firing pin, a hammer and a safety device.

At a front attachment point for the sub-calibre barrel it is usual to find four screws for the zeroing of the sub-calibre barrel, that is to say for its adjustment relative to the centre axis of the principal weapon. These screws are no longer accessible once the training weapon has been inserted into the principal weapon. Zeroing of the sub-calibre barrel must, therefore, be effected by repeatedly removing the training weapon from the principal weapon.

It is desirable, however, to be able to adjust the sub-calibre barrel without the need to remove the training weapon from the principal weapon. This is particularly true when repeated zeroings must be made after several firings. In order to be able to make such zeroings, it would, however, be necessary to bore holes in the wall of the barrel of the principal weapon so as to expose the zeroing screws. Such drilling of the wall of the barrel is, of course, generally unacceptable.

In conjunction with shooting training exercises with, for example, a recoilless antitank weapon intended for firing one round, it has been usual until now to overcome the aforementioned problems of zeroing by the simple expedient of manufacturing a simulator in the form of an exact copy of the live antitank weapon. Since the simulator is not intended to serve as a weapon for firing live ammunition, but simply as a holder for a training weapon, it has been found to be possible without causing any inconvenience to drill holes for the zeroing screws in the simulator.

The object of the present invention is, therefore, to propose a training weapon which will permit shooting training exercises to take place using a weapon intended for shooting with live ammunition, at the same time as zeroing can be effected even after the training weapon has been inserted into said weapon.

Figure 2:
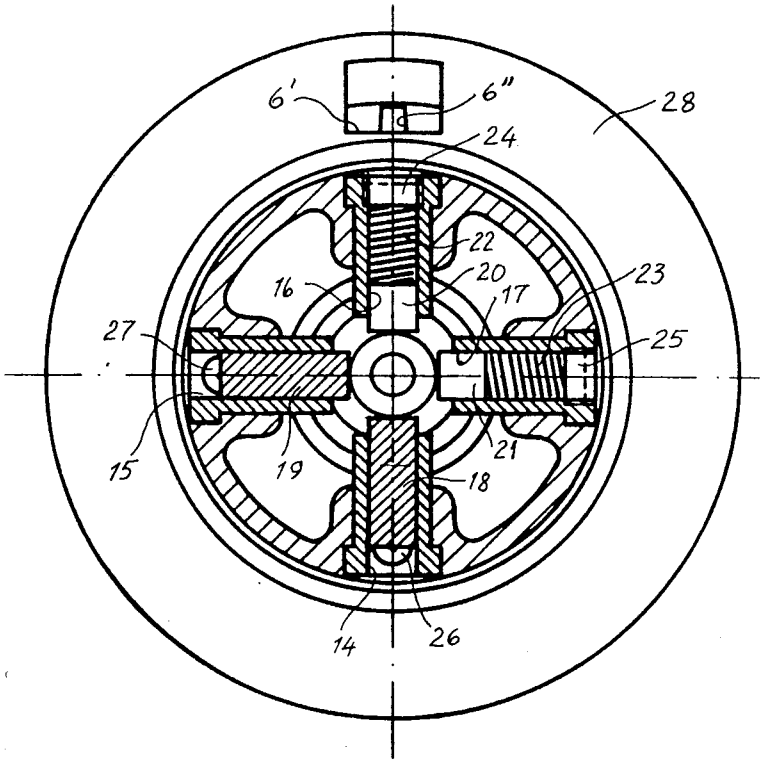

FIG. 1 shows a longitudinal section through a preferred embodiment of a training weapon in accordance with the invention, whereas FIG. 2 shows a cross-section along the line II—II in FIG. 1.

FIG. 1 shows the rear part of a conventional, recoilless antitank weapon 1 intended for firing one round, below referred to as a disposable weapon, the gas vent orifice of which (not shown) is removed in order to permit the attachement of a training weapon 2. The disposable weapon 1 exhibits in a previously disclosed fashion a hammer bolt 3 intended to interact with a conventional firing pin (not shown), which has been removed in order to be replaced by a transfer bolt 4 (see below) on the training weapon 2.

The training weapon 2 consists of a sub-calibre barrel 5, that is to say a barrel having a smaller calibre than that of the disposable weapon 1, said sub-calibre barrel being supported by an essentially cylindrical holder 6 in a rear, annular socket 7, which fits in a corresponding annular recess 8 in the rear part of the sub-calibre barrel 5, said holder 6 coaxially enclosing the sub-calibre barrel 5. The training weapon is equipped with a breech 9 of a previously disclosed nature, for which reason its function need not be described here. The breech 9 has a hammer 10 which is capable of indirect actuation by the bolt 3 of the disposable weapon via a firing pin housing 11 capable of attachment to the disposable weapon 1. The firing pin housing 11 accordingly incorporates a transfer bolt 4 actuated by the bolt 3, as described above, the rear end of which has a striking head 12 for the purpose of interacting with the hammer 10. The transfer bolt 4 is retained in the inactive position shown in FIG. 1 by means of a return spring 13.

The rear part of the firing pin housing 11 has the same dimension as a corresponding recess 6' in the holder 6. When the firing pin housing 11 has been attached to the disposable weapon, and when the training weapon 2 has been inserted into the barrel of the former, the rear part of the housing 11 will engage in the recess 6'. The presence in the latter of a transcurrent hole 6'' allows the striking head 12 to pass through the hole 6'' and to come up against the hammer 10.

In the front part of the holder 6 are made at a relative spacing of 90 degrees four transcurrent holes or bores 14–17 arranged radially in relation to the sub-calibre barrel. Inside each bore 14–17 there is arranged in such a way as to be capable of displacement an adjusting element in the form of a piston 18–21 in contact with the sub-calibre barrel 5. In each pair of opposing pistons 18–20 and 19–21, one of the pistons 20 or 21 is held under pressure against the periphery of the sub-calibre barrel 5 by means of a coil spring 22 or 23 arranged in the respective bore, said springs being retained in their respective bores by means of a set screw 24 or 25. The opposing pistons 18 and 19 are held under pressure against the sub-calibre barrel 5 by means of individual operating rods in the form of an adjuster screw 26 or 27 which runs parallel with the holder 6 at a distance from it which is less than one half of the calibre of the disposable weapon. It is possible to make sure in this way that the adjuster screws 26 or 27 will reach inside the wall of the barrel of the disposable weapon 1 when the training weapon 2 is inserted into the disposable weapon.

The end of the pistons 18 and 19 which faces away from the sub-calibre barrel 5 (of which only the end 18' is shown in FIG. 1) is bevelled at an angle of 45 degrees and is in contact with an end of the screws 26 or 27, similarly bevelled at an angle of 45 degrees (of which only the end 26' is shown in FIG. 1). In this way an axial displacement of the adjuster screws 26 and 27 will cause a radial displacement of the pistons 18 or 19 in such a way as to modify the correction of the tube.

The adjuster screws 26 and 27 terminate at the rear of the holder 6 in such a way that they are accessible even after the training weapon 2 has been inserted into the disposable weapon 1.

In the embodiment shown here the rear part of the container 6 is executed in the form of a funnel 28 intended faithfully to simulate the gas vent pipe removed from the single-shot weapon 1.

In order to facilitate the installation of the training weapon 2 in the disposable weapon 1, its holder 6 is provided with an external heel 29, which fits into a corresponding, internal recess 30 in the wall of the barrel of the disposable weapon. The holder 6 is also provided with three threaded holes 31, which are situated in such a way that they are in line with three holes 32 in the wall of the barrel of the disposable weapon 1, said latter holes being intended for the attachement of the vent pipe of the disposable weapon. In this way the holes 32 in the disposable weapon for the vent pipe may be used for locking the holder 6 securely to the disposable weapon.

The rear firing pin housing 11 is capable of being attached to the wall of the disposable weapon by means of a screwed connection (not shown).

The correction of the sub-calibre barrel 5 can be effected after the training weapon 2 has been inserted into the disposable weapon 1 by adjusting either or both of the adjuster screws 26 or 27. The adjustment of the adjuster screw 26, for example, will cause the piston 18 to move relative to the sub-calibre barrel 5, in which case the opposing piston 20 with its spring 22 will act as a restraint or a restraint spring.

It is obvious that the invention may be modified by causing the transfer of movement between the adjuster screws 26 and 27 and the associated pistons 18 and 19 to take place instead via a cam arrangement. It is also possible to replace the pistons 18–21 with expanding elements of, for example, a rubber or plastics material.

I claim:

1. Training means for shooting with a weapon intended to be used with live ammunition, said training means comprising a sub-calibre barrel, which is attached inside a holder, which is capable of being placed inside the barrel of said weapon, said holder exhibiting a number of adjusting elements in contact with the sub-calibre barrel and capable of displacement in its transverse direction in order to provide zeroing of the sub-calibre barrel, two of the adjusting elements are each operatively connected to an individual adjuster means, which extends essentially parallel with the sub-calibre barrel and at a certain distance from it which shall be less than one half of the calibre of the barrel, and for a sufficient distance rearwards for its free end to be accessible inside a rear part of the holder, as seen in the shooting direction.

2. Training means in accordance with claim 1 for a recoilless weapon, wherein the barrel of which exhibits a detachable gas vent pipe, and the holder has a rear, tubular part, which is so dimensioned as to be capable of occupying the position of said gas vent pipe in the recoilless weapon.

3. Training means in accordance with claim 1, wherein two of the adjusting elements are spring-loaded.

* * * * *